US005794264A

United States Patent [19]

Yuen

[11] Patent Number: 5,794,264

[45] Date of Patent: Aug. 18, 1998

[54] TRAVELER'S STOW-AWAY JACKET

[76] Inventor: Melville Yuen, 1709 Wilhelmina Rise, Honolulu, Hi. 96816

[21] Appl. No.: 850,756

[22] Filed: May 2, 1997

[51] Int. Cl.[6] ..... A41D 15/00

[52] U.S. Cl. ..... 2/93; 2/94; 2/247; 2/311

[58] Field of Search ..... 2/93, 94, 247, 2/250, 311, 312

[56] References Cited

U.S. PATENT DOCUMENTS

| | | | |
|---|---|---|---|
| 4,689,831 | 9/1987 | Greenberger et al. | 2/93 |
| 4,862,520 | 9/1989 | Gazzola | 2/93 |
| 4,944,042 | 7/1990 | DeWan | 2/93 |
| 5,010,592 | 4/1991 | Skiles, Jr. | 2/93 |

*Primary Examiner*—C. D. Crowder
*Assistant Examiner*—Shirra L. Jenkins
*Attorney, Agent, or Firm*—Patent & Trademark Services; Thomas Zack; Joseph H. McGlynn

[57] ABSTRACT

A stow-away traveler's jacket made from a one or two piece modular construction. The upper jacket or torso covering section has arm outlet and resembles a shortened version of a conventional jacket. The lower section has a belted portion or some other user fastening device and at least one storage liner pocket into which the folded upper section may be stowed and then worn like a belt. There may be storage pockets made of two flapped front pockets.

4 Claims, 1 Drawing Sheet

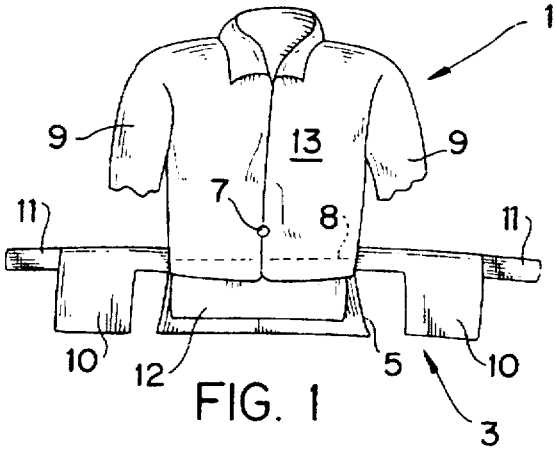
FIG. 1
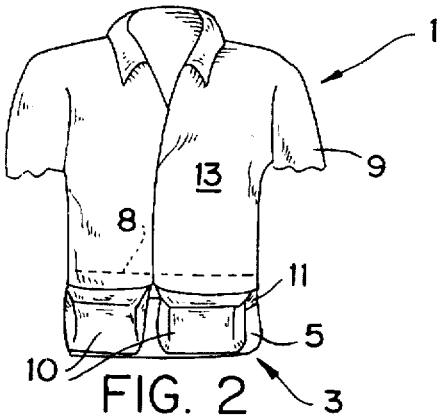
FIG. 2
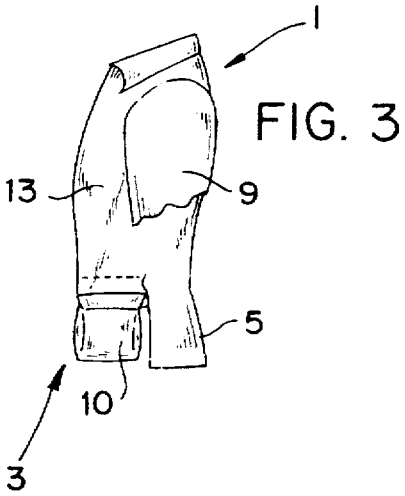
FIG. 3
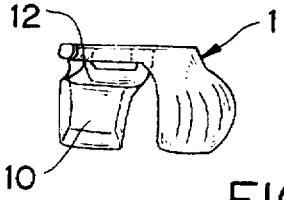
FIG. 4
FIG. 5
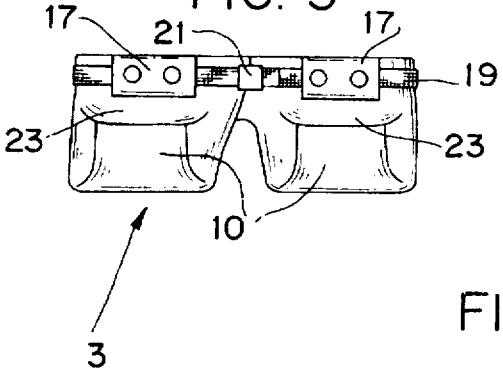
FIG. 6
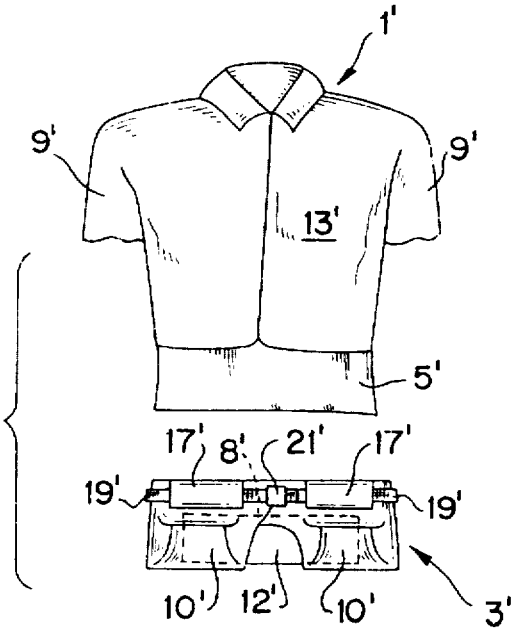

TRAVELER'S STOW-AWAY JACKET

BACKGROUND OF THE INVENTION

Anyone who plans on going outdoors must consider weather conditions such as the possibility of rain or cooler temperatures when deciding on what to wear. If you decide not bring a jacket at all and the weather conditions turn out for the worst, then you have left yourself unprotected. Or you may bring a jacket and wear it when it's cold and or raining and as the weather gets better you end up with the inconvenience of carrying the jacket on your arm. The present invention was meant to address these problems by providing for a means of carrying jacket for emergency situations where the main body of the jacket can be neatly rolled and stored away and worn with a belt and waist pack when it is no longer needed. Meanwhile, the jacket's belt and waist pack is readily available to the wearer for carrying small items.

DESCRIPTION OF THE PRIOR ART

Garments having self-storing features are known in the prior art. For example, in U.S. Pat. No. 4,689,831 to Greenberger et al., a garment with a side pocket having straps on its inside can be folded into the pocket and carried as a carrying pack. In the Gazzola invention (U.S. Pat. No. 4,862,520) a zippered belted overcoat can be converted into a bag with a shoulder-belt. DeWan (U.S. Pat. No. 4,944,042) discloses an article in which a disengage able functional tubular part (e.g., lower sleeve or leg) can form a carrying container for the article. And in U.S. Pat. No. 5,010,592 to Skiles, Jr. a self-storing coat with a pocket attached to its lining is disclosed. The present invention presents a unique self-storing jacket having a belted pocket as set forth in this specification.

SUMMARY OF THE INVENTION

A modular constructed piece belted jacket having an upper torso section with either a partially or totally separable lower belted section with at least one storage pocket. By rolling and folding the jacket's upper section the lower section's pocket may be used to store and carry the upper section. The lower section pocket may be formed as a separate distinguishable item in the lower section or be joined to and be part of the lower section's interior lining. Alternately, with the two piece design the lower section's lining may be used to store the upper section thereby allowing other items to be carried in the pockets.

The primary object of the present invention is to provide an improved modular garment which is self-storing.

A secondary object to provide a lower pocketed garment section which can store the upper jacket section.

These and other objects and advantages of the present invention will become apparent to readers from a consideration of the ensuing description and the accompanying drawings.

BRIEF DESCRIPTION OF THE DRAWINGS

FIG. 1 is a front view of the invention's preferred embodiment.

FIG. 2 is a front view of the FIG. 1 embodiment with the lower belted pocketed section closed.

FIG. 3 is a side view of the FIG. 1 embodiment with the lower belted pocketed section closed.

FIG. 4 shows a side view of the FIG. 1 embodiment with its upper jacket section rolled and stored in a tail pocket created in the lower section.

FIG. 5 is a detailed front view of the lower section.

FIG. 6 is another embodiment of the invention having a lower front section storage pocket separated from the jacket's upper torso portion including its tail section.

DESCRIPTION OF THE PREFERRED EMBODIMENT

In the FIG. 1 front view of the invention's preferred embodiment the upper torso covering jacket section 1 is shown overlapping the top portion of the belted pocketed lower section 3. The upper section is a conventional jacket in all aspects except that its lower front body portion is abbreviated in length while its lower depending back tail portion 5 extends full length. The torso section's front portion may have a front zippered or buttoned 7 vertically disposed front closure or the like. Its two arm outlet sleeves 9 may be either full or shortened in length. The belted pocketed lower section 3 is shown opened or flat in FIG. 1. This lower jacket section is connected to the upper jacket section at the tail portion. Lower section 3 has two front pockets 10 and an upper belted portion 11 extending across its width. A storage liner 12 having an openable horizontal upper side extends across the width of the tail on the inside and is used to store the entire upper section 1. A horizontally disposed zipper 8(shown in dotted line format), elasticized edge or other fastener runs across the liner 12's opened top edge and is used to close the liner.

The belted portion 11 may have belt loops which support a buckled belt (not shown) to hold this section around a user's waist. In this figure the lower depending middle tail portion 5 overlaps and joins the lower section's upper belted portion 11 and the two end pockets 10 are viewed from their back sides.

FIG. 2 is a front view of the FIG. 1 embodiment with the lower belted pocketed section 3 closed around the waist of a user. This section's belted upper part 11 is hidden from view by the lower back trail edge 5 of the jacket 13. The two pockets 10 now rest on the user's front under the upper section 1. In the next figure, FIG. 3, a side view of the FIG. 2 embodiment with the lower belted pocketed section closed is shown. From all outward appearances the jacket appears to be a standard constructed front pocketed jacket with a depending tail portion 5.

When the jacket's upper torso section 1 is no longer needed, it may be rolled and folded and stowed away into the storage liner 12. FIG. 4 shows a side view of the FIG. I embodiment with its upper jacket section as it is in the process of being stored in the lower section's storage liner 12. When completely stowed, only the pockets 10 and their belted upper portion 11 will be visible. At that time a user simply fastens the belted portion around his or her waist with the upper jacket section 1 safely stowed away.

FIG. 5 is a detailed front view of the lower section 3 shown in FIG. 2 with a belt 19 sewn or attached to the waist of the top portion of the jacket. This belt 19 extends through the belt loops 17 and is fastened by the center belt buckle 21.

FIG. 6 is another modular constructed embodiment of the invention in which the lower section's 3' storage pocket is separately formed from the upper torso section 1'. This second embodiment differs from the first embodiment since it has two separate sections where the front pockets are separate from the top or torso portion of the jacket. The storage liner 12' with its upper zipper closure 8' is attached to belt section 17 in the lower section 3' but is not shown as it is behind the two front pockets 10'. In the second embodiment more details on the belted portion are shown including the upper spaced belt loops 17' (two shown) extending completely around the user's waist into which a belt 19 with a buckle 21 can be inserted and belted.

Items having the same basic construction and function in both embodiments have been designated by the same numbers with a prime added to the second embodiment.

Although the Traveler's Stow-Away Jacket and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A stow away garment comprising:

an upper torso covering garment section having arm outlets, a closable torso front portion and a depending back portion; and a lower garment section joined to said upper section along its depending back portion, said upper garment section depending back portion overlapping said lower section where joined thereto with said lower section having at least one storage pocket liner and an upper belted portion located outside of said pocket liner, whereby said back portion can conceal the lower section's upper belted portion along its overlapping part to conceal from view the pocket liner and the stored upper section and upper garment section being foldable and storable in said lower section's storage liner and capable of being worn when so folded on a user's waist by fastening the lower section's upper belted portion there around.

2. The invention as claimed in claim 1, wherein there are an additional storage pockets in said lower section which can be used to store items.

3. The invention as claimed in claim 1, wherein pocket lining has closure means located adjacent said belted portion to permit the closing of said liner.

4. The invention as claimed in claim 3, wherein said lining's closure means is a horizontally disposed zipper which extends substantially the entire length of said lining.

* * * * *